US010697716B2

(12) United States Patent
Abell et al.

(10) Patent No.: US 10,697,716 B2
(45) Date of Patent: Jun. 30, 2020

(54) HEAT EXCHANGER AND HEADER PLATE FOR HEAT EXCHANGER

(71) Applicant: MAHLE International GmbH, Stuttgart (DE)

(72) Inventors: Bradley Abell, Clarkston, MI (US); Jeffrey Allan Dunker, Englewood, OH (US)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 0 days.

(21) Appl. No.: 15/691,074

(22) Filed: Aug. 30, 2017

(65) Prior Publication Data

US 2019/0063852 A1 Feb. 28, 2019

(51) Int. Cl.

| | |
|---|---|
| ***F28F 9/02*** | (2006.01) |
| ***F28D 1/053*** | (2006.01) |
| ***F28F 9/18*** | (2006.01) |
| ***F28F 9/00*** | (2006.01) |
| *F28F 21/08* | (2006.01) |
| *F28D 21/00* | (2006.01) |
| *F28F 21/06* | (2006.01) |

(52) U.S. Cl.

CPC ..... *F28F 9/0248* (2013.01); *F28D 1/05308* (2013.01); *F28D 1/05366* (2013.01); *F28F 9/001* (2013.01); *F28F 9/0224* (2013.01); *F28F 9/0256* (2013.01); *F28F 9/18* (2013.01); *F28D 2021/0094* (2013.01); *F28F 9/0246* (2013.01); *F28F 21/067* (2013.01); *F28F 21/08* (2013.01); *F28F 2225/08* (2013.01); *F28F 2255/02* (2013.01); *F28F 2265/26* (2013.01)

(58) Field of Classification Search

CPC ..... F28F 9/0248; F28F 9/0256; F28F 9/0246; F28F 9/0224; F28F 9/18; F28F 2255/02; F28F 2265/26; F28D 1/05308; F28D 1/05366

USPC ..... 165/175

See application file for complete search history.

(56) References Cited

U.S. PATENT DOCUMENTS

| | | | | |
|---|---|---|---|---|
| 5,678,628 | A * | 10/1997 | Aki | F28F 9/0224 165/149 |
| 8,074,708 | B2 * | 12/2011 | Sugito | F28D 1/05366 165/173 |
| 8,915,294 | B2 * | 12/2014 | Mazzocco | F28F 9/0212 165/149 |
| 2002/0053423 | A1 * | 5/2002 | Koizumi | F28D 1/05366 165/149 |

(Continued)

FOREIGN PATENT DOCUMENTS

| | | | |
|---|---|---|---|
| DE | 20005523 | U1 | 8/2001 |
| DE | 102006006946 | A1 | 8/2007 |
| DE | 102014219208 | A1 | 3/2016 |

(Continued)

*Primary Examiner* — Joel M Attey

(74) *Attorney, Agent, or Firm* — Dickinson Wright PLLC

(57) ABSTRACT

A tube header for a heat exchanger may include: a header plate having two major dimensions defining a header plane, and a plurality of tie bars, each tie bar arranged between a pair of adjacent oblong passages. In particular, the header plate has a row of oblong passages extending through the header plate, and the header plate includes a core cover slot of which opening length is equal to or greater than three quarters of an opening length of one of the oblong passages to receive a tube.

18 Claims, 8 Drawing Sheets

(56) References Cited

U.S. PATENT DOCUMENTS

| | | | |
|---|---|---|---|
| 2017/0010058 | A1 | 1/2017 | Abell et al. |
| 2017/0010059 | A1 | 1/2017 | Abell et al. |

FOREIGN PATENT DOCUMENTS

| | | | |
|---|---|---|---|
| DE | 102015014047 | A1 | 5/2017 |
| EP | 0307803 | B1 | 3/1989 |
| KR | 10-2004-0103264 | A | 12/2004 |

* cited by examiner

HEAT EXCHANGER AND HEADER PLATE FOR HEAT EXCHANGER

FIELD

The present application relates to a structure of a heat exchanger having a tube header and a core cover.

BACKGROUND

The statements in this section merely provide background information related to the present disclosure and may not constitute prior art.

Heat exchangers are used to transfer heat from one fluid to another fluid. Heat exchangers have various uses within an automotive vehicle. For example, in a radiator, heat is transferred from a cooling liquid to the ambient air. In particular in motor vehicles the heat exchanger is used to discharge waste heat released by the internal combustion engine into the ambient air. The cooling medium that flows through the heat exchanger may be a liquid or, in some applications, a gaseous fluid.

Heat exchangers of the radiator type include a plurality of parallel tubes and two header boxes. The header boxes are typically multi-part structures having a header tank and a tube header. The tube header includes a central header plate with passages bordered by side walls forming a ferrule. The ends of the tubes are inserted into the ferrules to establish a fluid communication between the tube header and the interior volume of the tubes. The tubes may be formed from folded or welded sheet metal. While welded tubes are generally more durable, folded tubes are less costly to manufacture.

During operation, the service life of the heat exchanger may be shortened due to non-uniform expansion of the individual components of the heat exchanger when heating up and cooling down and the deformation or displacement resulting therefrom. The stresses can be attributed to the changing thermal conditions in the heat exchanger.

In the past, attempts have been made to extend the service life of heat exchangers by modifying the transition between the tube header and the inserted folded tubes, with limited success.

SUMMARY

The present disclosure provides a structure of a heat exchanger having a tube header and a core cover, which improves service life of the heat exchanger. In particular, the heat exchanger increases the service life of the heat exchanger by reducing bending forces/moments on the corners of the tube header when subjected to thermal, pressure, or vibrational loading.

In one form of the present disclosure, a tube header for a heat exchanger may include: a header plate having two major dimensions defining a header plane, the header plate having a row of oblong passages extending through the header plate, and a plurality of tie bars, each tie bar arranged between a pair of adjacent oblong passages. In particular, a header plate includes a core cover slot of which opening length is at least three quarters of an opening length of one of the oblong passages to receive a tube.

In one form of the present disclosure, the opening length of the core cover slot is at least equal to or greater than the opening length of one of the oblong passages.

In another form, at least one of the plurality of tie bars is a slot support tie bar including a first side wall and a second side wall, and the first side wall adjacent to the tube has a different length or a different height than the second side wall adjacent to the cover slot. In particular, a length of the first side wall may be greater than a length of the second side wall, and a height of the first side wall may be greater than a height of the second side wall.

As one aspect of the present disclosure, the core cover slot is formed by the second side wall and a flange which is attached to a header tank of the heat exchanger.

In other form, the first side wall has a transition area having a reduced wall thickness that is smaller than a wall thickness of a ferrule forming a corresponding oblong passage to receive the tube.

In the tube header, each oblong passage is bordered by the ferrule monolithically formed with the header plate, the ferrule with a wall thickness has a surrounding wall extending perpendicular to the header plane, and at least one ferrule is extended by the first side wall toward the header plane.

A wall thickness of the second side wall may be greater than the wall thickness of the ferrule, and the wall thickness of the first side wall is gradually reduced over the transition area with a slope angle.

In one form, a depth of the core cover slot is greater than a depth of the ferrule.

A height of core cover slot from the header plane may be less than a height of the ferrule from the header plane.

As another aspect of the present disclosure, a transition area with a reduced wall thickness of the second side wall is shorter than the transition area of the first side wall.

The present disclosure provides another form of a heat exchanger with at least one header box and a plurality of tubes extending therefrom. The header box includes a tube header having: a header plate defining a header plane; a row of oblong passages extending through the header plate, and a plurality of tie bars, each tie bar arranged between a pair of adjacent oblong passages. In particular, the header plate includes a core cover slot of which opening length is at least three quarters of an opening length of one of the oblong passages to receive the plurality of tubes, respectively.

The heat exchanger may further includes a core cover having, at ends, at least two tabs each having a width equal to or greater than the opening length of one of the oblong passes.

Each tab includes a laterally extended portion toward outside to secure the core cover to the tube header.

In one form, at least one of the two tabs includes a recessed portion adjacent to the extended portion to hold the header plate when the core cover is assembled with the tube header.

After assembled, the extended portion of the tab is fixed on the tube header by brazing.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
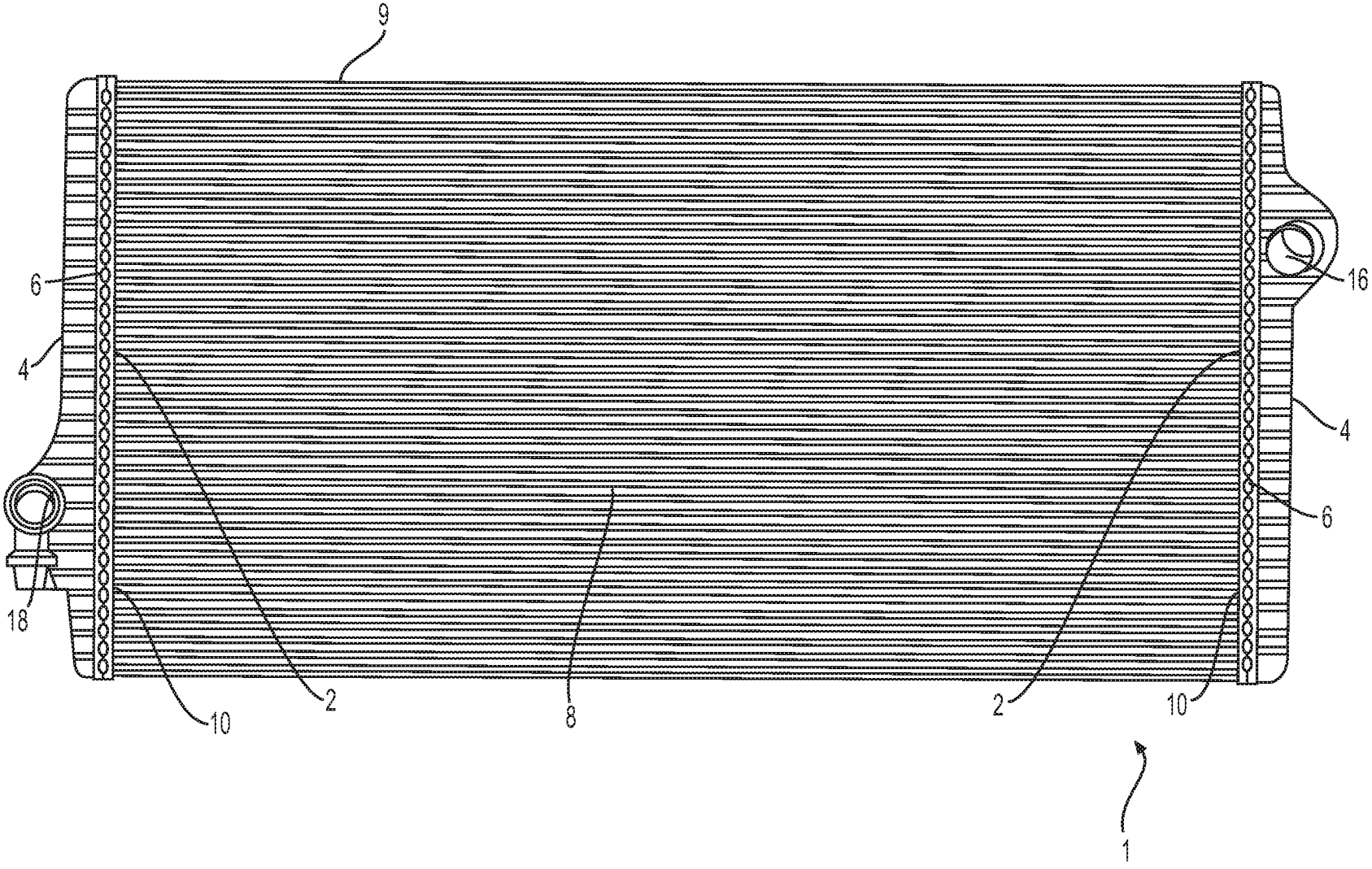
FIG. 1 is a perspective view of a heat exchanger in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As one form of the present disclosure, FIG. 1 shows a heat exchanger 1 that has two opposing tube headers 2. Each tube header 2 is attached to a header tank 4 indicated in broken lines. The tube headers 2 and the header tanks 4 form two header boxes 6 on opposite ends of the heat exchanger 1. The shape of the header tanks 4 is dictated by the architecture of the vehicle, in which the heat exchanger 1 is to be installed, and the indicated header tanks 4 only constitute a general schematic representation of header tanks 4 that may have different shapes and may have additional features, for example for installation of the heat exchanger 1 in a vehicle or for attaching sensors to the header tank. The header tanks 4 may be formed from injection-molded plastic that may include reinforcement structures, such as stiffening ribs located on the outside of the header tanks 4.

Arranged between the tube headers 2 are tubes 8 with elongated cross-sections. The tubes 8 are placed adjacent to one another and extend parallel to one another in a row. The tubes 8 have tube ends 10 that pass through passages 12 in the tube header 2 as will be explained in greater detail in connection with FIG. 5. The tubes 8 bring the two header boxes 6 in fluid communication with each other. Cooling fins 14, which are elongated flat metal strips bent in a zigzag or serpentining shape (see FIG. 5), are placed between adjacent tubes 8 for increasing the cooling surface of the heat exchanger 1. The matrix of alternating tubes 8 and cooling fins 14 is bordered at each end by a core cover 9 extending from one tube header 2 to the other and forming an outer surface of the heat exchanger 1.

When the heat exchanger 1 is designed as radiator, the cooling medium enters an interior of one of the two header boxes 6 through an inlet opening 16 provided in the header box 6. The cooling medium to be cooled distributes itself in the interior, enters the tubes 8, and flows through them. In this process, cooling of the hot cooling medium takes place via the surfaces of the tubes 8 and of the cooling fins 14, and the cooled cooling medium in turn enters an interior of the other header box 6 at the other tube ends 10 of the tubes 8. The other header box 6 contains an outlet opening 18, through which the cooling medium, which has in the meantime been cooled, is delivered to the device to be cooled, for example the internal combustion engine.

The tubes 8 and the cooling fins 14 located between them are exposed to a cooling air flow. In this process, the heat energy of the hot cooling medium flowing through the tubes 8 is transferred to the surfaces of the tubes 8 and from there to the cooling fins 14, and is then carried away by the cooling air flow.

Figure 2A:
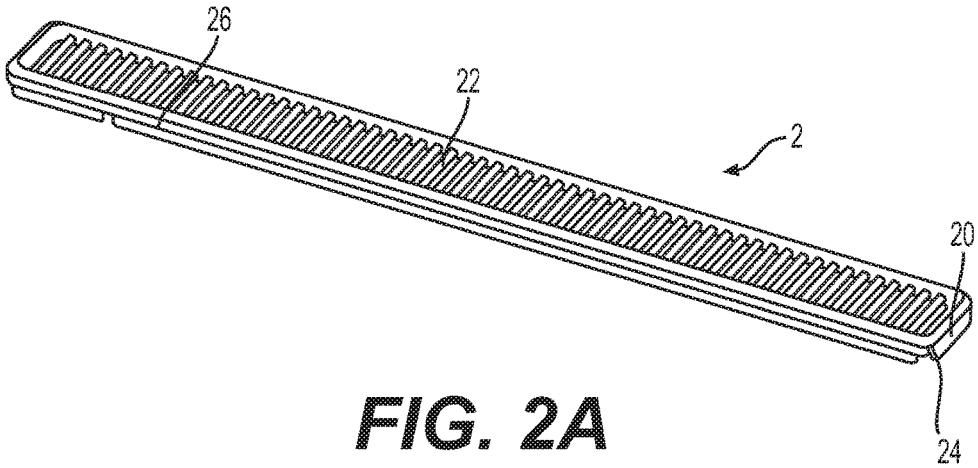
FIG. 2A is a perspective view of a tube header suited for the heat exchanger of FIG. 1.
Figure 2B:
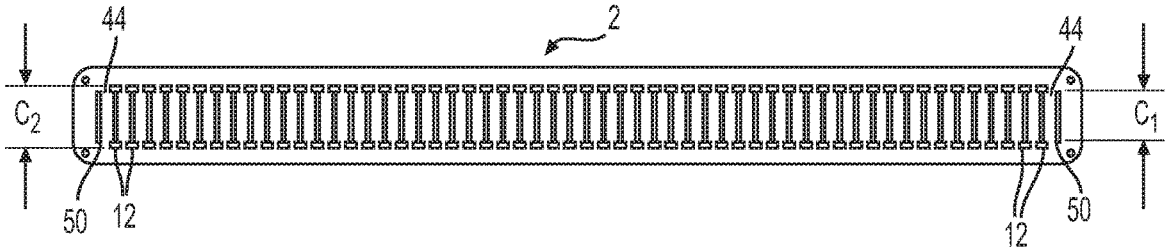
FIG. 2B is a top view of a tube header of FIG. 2A.
Figure 2C:
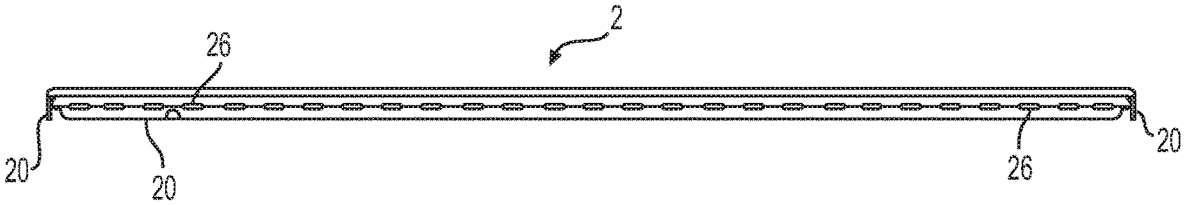
FIG. 2C is a side view of the tube header of FIG. 2A.

FIGS. 2A-2B show the general dimensions of a tube header 2 suited for the use in a heat exchanger 1 of the type shown in FIG. 1. The tube header 2 of FIG. 2A is shown from an outside of a header box 6, which is the side from which, in the assembled state of FIG. 1, tubes 8 extend toward the second tube header 2 of a heat exchanger 1. In FIG. 2A, the tubes 8 would extend upward. FIG. 2A is a perspective view, FIG. 2B is a top view of the tube header 2 in FIG. 2A, and FIG. 2C is a side view of the tube header 2 in FIG. 2B. The tube header 2 is manufactured from cold-formed sheet metal, for example aluminum.

The length L and the width W of the tube header 2, constituting the two greatest dimensions of the tube header 2, define a header plane A. In the perspective of FIG. 2A, the length L, forming the greatest dimension of the tube header 2, extends sideways along the image plane, and the width W extends into the image plane.

The tube header 2 has a generally rectangular outer periphery bordered by attachment portions in the form of flanges 20 extending along each of the four sides of the periphery for attaching the tube header 2 to the header box 6. From a central header plate 22 that extends in the header plane A, the flanges 20 extend transverse to the header plane A toward the header box 6 and are separated from each other by slots 24 in the four corners of the tube header 2 for added flexibility during assembly. Punched perforations 26 in the flanges 20 further add to the flexibility of the flanges 20.

Figure 3:
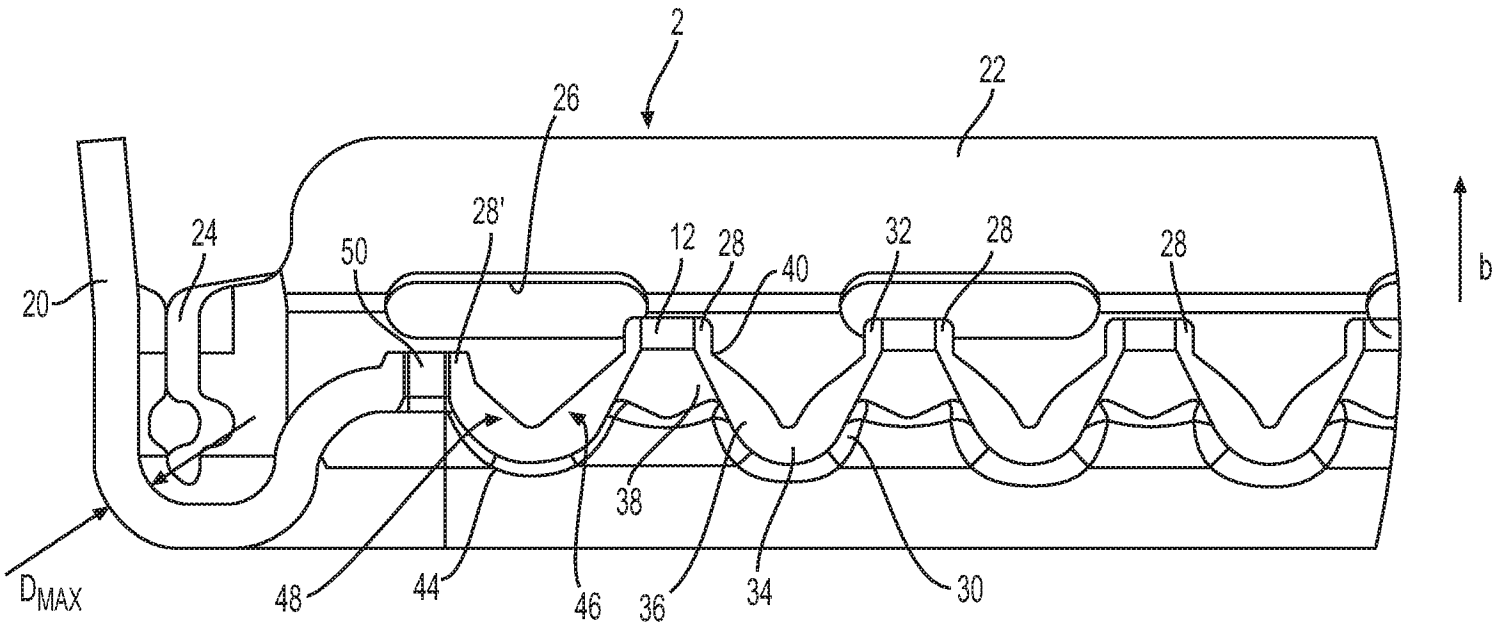
FIG. 3 is a cross-sectional detail view of the tube header of FIG. 2A.

FIG. 3 shows a partial cross-section of a tube header 2. The header plate 22 of the tube header 2 bears a row of ferrules 28 alternating with tie bars 30 or 44, respectively. The ferrules 28 surround elongated passages 12 extending along the direction of the width W of the tube header 2. The elongated passages 12 match the elongated cross-section of the tubes 8, with two opposing wide sides and two opposing narrow sides. Each of the ferrules 28 forms a wall 32 surrounding one of the passages 12. The wall 32 extends toward the interior of the header box 6.

The tie bars 30 and 44 provide a corrugation of the tube header 2 and thus provide increased stability for the overall structure of the tube header 2. To this end, the tie bars 30 are trough shaped and are arranged parallel to the passages 12. The bottoms 34 of the trough-shaped tie bars 30 point toward the outside of the header box 6. The tube header 2 includes two of the tie bars 44, which are slot support tie bars 44 arranged between one of the passages 12 and a core cover slot 50 as illustrated in FIGS. 2B and 3.

Figure 4A:
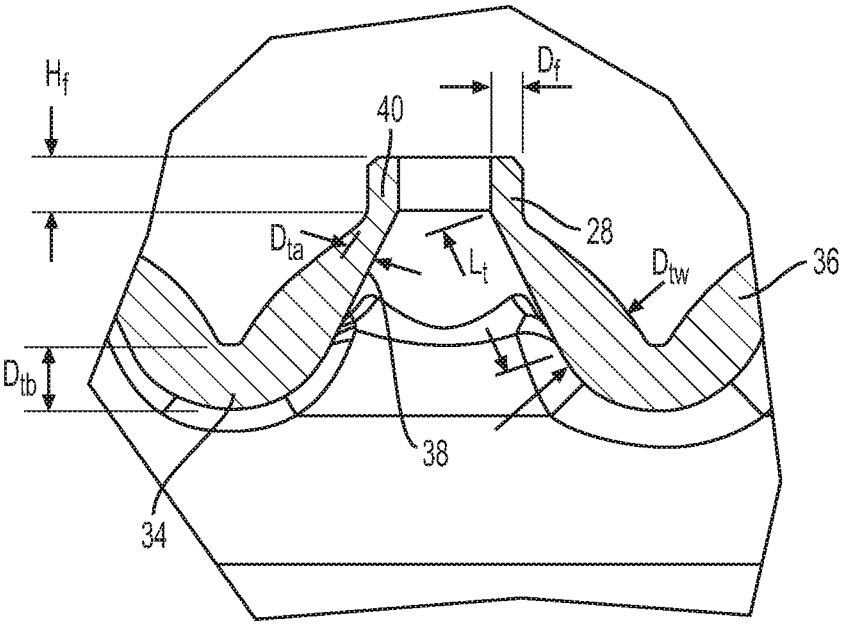
FIG. 4A shows a magnified detail of a ferrule forming an oblong passage of FIG. 3.
Figure 4B:
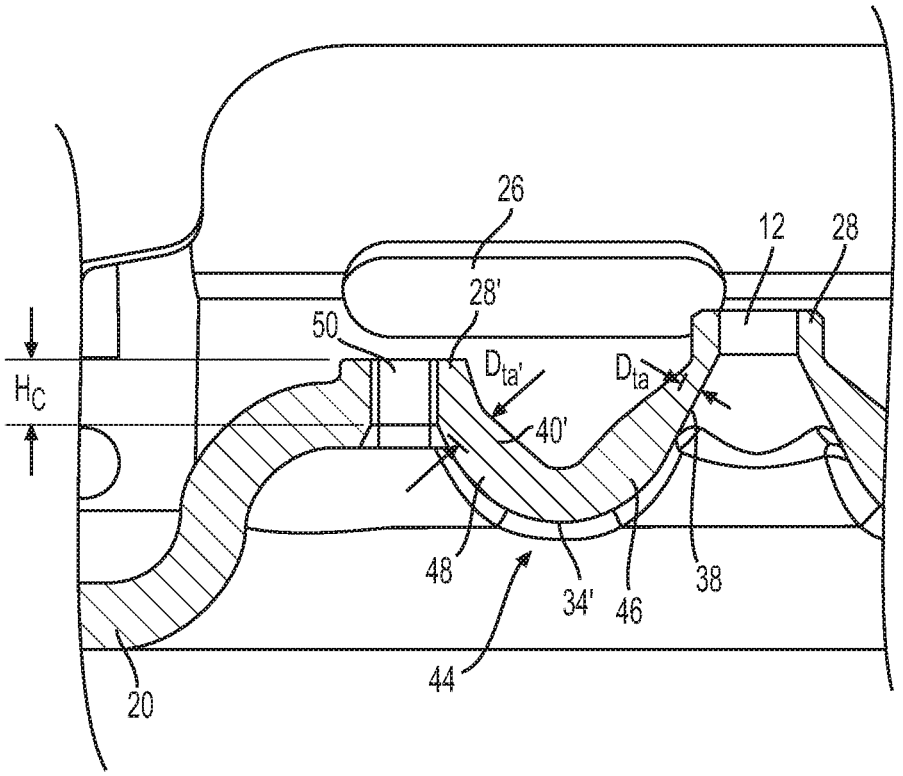
FIG. 4B shows a magnified detail of a slot support tie bar for a core cover slot of FIG. 3.

In FIGS. 4A and 4B, the trough-shaped tie bars 30 and the slot support tie bar 44 are shown in detail. The profile of the slot support tie bar 44 is shown in FIG. 4B and an enlarged view of the trough-shaped tie bars 30 is shown in FIG. 4A.

Referring again to FIG. 3, the tube header 2 is composed of the header plate 22, the flanges 20, and the ferrules 28. The header plate 22 includes the row of oblong passages 12 extending through the header plate 22. Each passage 12 is bordered by a ferrule 28 monolithically formed with the header plate 22. Each of the ferrules 28 has a surrounding wall 32 (hereafter ferrule wall) extending perpendicular to the header plane A. Between adjacent passages 12, the header plate 22 includes the trough-shaped tie bars 30 alternating with the passages 12. The trough-shaped tie bars 30 provide additional dimensional stability to the tube header 2 via a corrugation effect. The tube header 2 has a maximum thickness Dmax that is present, for example, in an area where the header plate 22 transitions into the flanges 20.

Now referring to FIG. 4A, the ferrules 28 have a wall thickness Df that is smaller than the maximum thickness Dmax of the tube header 2. For example, the wall thickness Df of the ferrules 28 may be about 30% to 50% of the maximum thickness Dmax of the tube header 2. In contrast thereto, the trough-shaped tie bars 30 have side walls 36 with a local thickness Dtw that may be equal to or only slightly smaller than the maximum thickness Dmax. In one form, the bottom 34 of the tie bar 30 has a reduced thickness Dtb in comparison with the side walls 36.

The side walls 36 transition into a tapered portion 38 with a gradually reduced thickness toward the ferrule 28. Outside of the header box 6, the tapered portion 38 forms a steady slope over a taper length Lt that is greater than the height Hf of the ferrule 28, thus avoiding an abrupt change in the thickness of the header plate 22. The tapered portion 38 has a constant slope angle relative to the header plane A in a range of 45° through 80°, i.e. an angle of 10° to 45° relative to the tubes 8. In one form, the slope angle is in a range of 60° through 66°, thus 24° through 30° relative to the direction of the tubes 8 shown in FIG. 5. At the transition from the tapered portion 38 to the ferrules 28, the thickness $D_{ta}$ of the tube header 2 has a minimum that is smaller than the thickness Df of the ferrule wall 32.

FIG. 4B shows a close-up cross-section of a slot support tie bar 44. The slot support tie bar 44 has two outer side walls 46, 48 connected to the adjacent ferrules 28, 28', respectively, via the transition area 40, 40'. More specifically, the first side wall 46 is directly connected to the ferrule 28 via the transition area 40 whereas the second side wall 48 is directly connected to the ferrule 28' via the transition area 40'. In one form, the first side wall 46 has a profile similar to the profile of the side wall 36 in that the first side wall 46 transitions into a tapered portion 38 with a gradually reduced thickness toward the ferrule 28 (see FIG. 4B).

As illustrated in FIG. 4B, a height of the first side wall 46 from the header plane A is greater than a height of the second side wall 48 from the header plane A. In addition, a length of the first side wall 46 is greater than a length of the second side wall 48 as shown in FIG. 4B. In other words, the profile of the first and second side walls 46, 48 are not symmetric to each other. In one form, the first side wall 46 is extended from one of the ferrules 28 toward the header plane A and may have a profile identical to the shape of side wall 36 of the tie bars 30. The side wall 36 and the first side wall 46 have in common the tapered portion 38 around the ferrule 28 as well as the transition area 40 having a reduced wall thickness $D_{ta}$ that is smaller than a wall thickness Df of the ferrule wall 32 forming a corresponding oblong passage to receive the tube.

Unlike the first side wall 46 having the shape substantially similar to the side wall 36, the second side wall 48 forming the core cover slot 50 with the flange 20 has a different profile compared to the profile of the first side wall 46. Even though the second side wall 48 may have a transition area 40' having a reduced wall thickness $D_{ta}'$, the wall thickness $D_{ta}'$ is greater than the wall thickness Df of the ferrule wall 32. Moreover, the transition area 40' with the reduced wall thickness $D_{ta}'$ of the second side wall 48 is shorter than the transition area 40 of the first side wall 46 as shown in FIGS. 4A-4B. In addition, a depth Hc of the core cover slot 50 in FIG. 4B is greater than the depth Hf of the ferrule 28 in FIG. 4A. The second side wall 48 and the flange 20 surround the elongated core cover slots 50 extending along the direction of the width W of the tube header 2. The elongated core cover slots 50 match the cross-section of a tab 70 of the core cover 9 (in FIGS. 6-8B) are in parallel to the elongated passages 12. In particular, an end portion (e.g., the tab 70) of the core cover 9 is inserted through the core cover slot 50 when assembled with the tube header 2. In one form, when the tab 70 is formed in both end portions of the core cover 9, and the core cover slots 50 are formed in both side end portions of the tube header 2 so as to respectively receive the corresponding tab 70 of the core covers 9.

Figure 5:
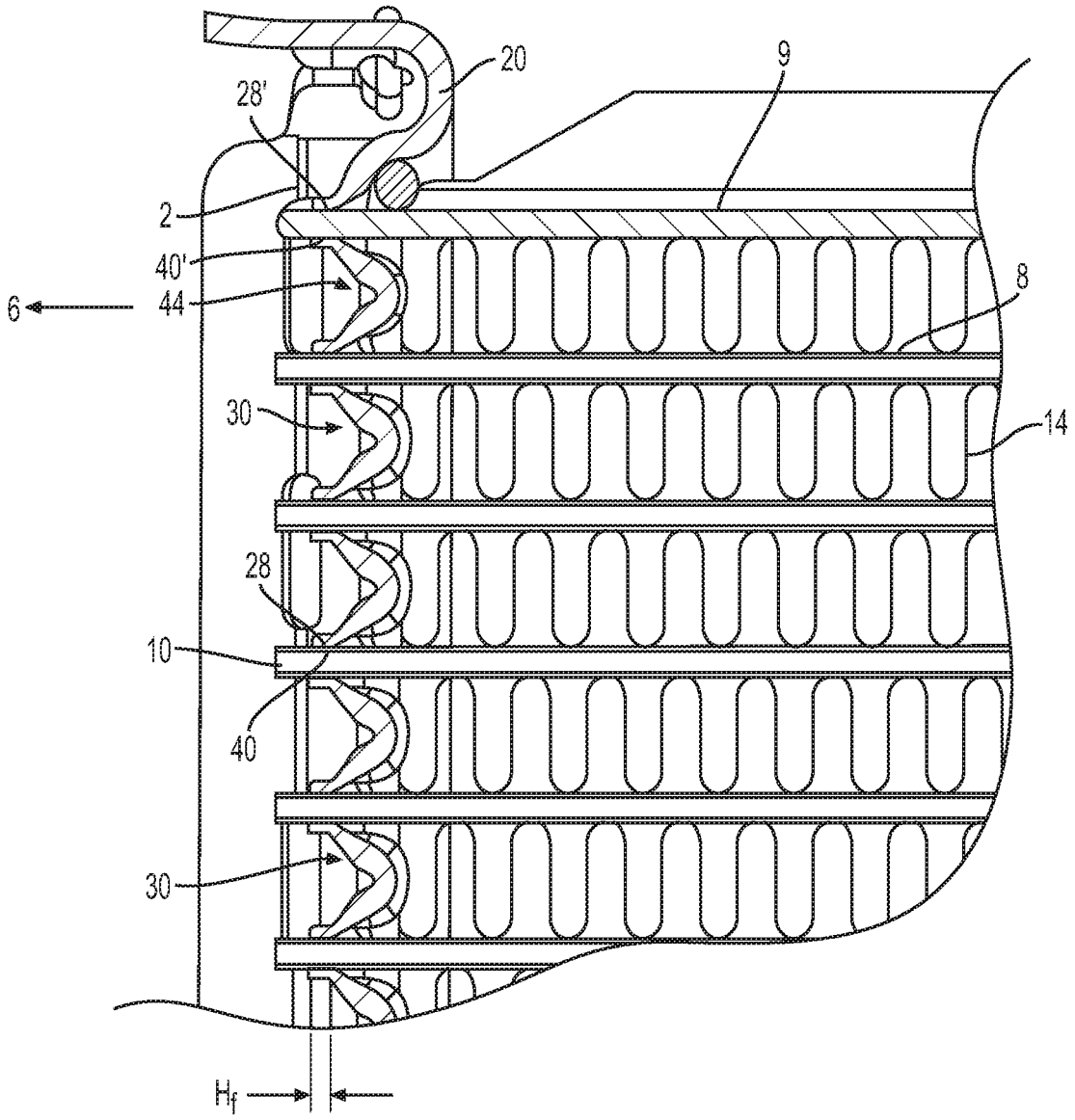
FIG. 5 shows a cross-sectional detail view of FIG. 3 with tubes inserted and with a core cover assembled.

The arrangement of the core cover 9, the tubes 8, and the tube header 2 is described with reference to FIGS. 1 and 5. FIG. 5 shows a cross-sectional view corresponding to FIG. 3, but with tubes 8 attached to the tube header 2. Between the tubes 8, serpentining cooling fins 14 provide large cooling surfaces. The tubes 8, which have elongated cross-sections, are carried in the ferrules 28 of the tube header 2 and extend beyond the ferrules 28 into the interior of the header box 6. The tubes 8 extend past the free ends of the ferrules 28 by a length that is at least equal to the height Hf of the ferrule 28. The transitional area 40 between ferrule 28 and tapered portion 38 is the area where the tube transitions from contacting the ferrule 28 with the tube surface to being out of contact with the tube header 2. Thus, the minimum thickness $D_{ta}$ (see FIG. 4A) of the tie bars 30 is located in the transitional areas 40 directly adjacent the ferrules 28 making contact with the tubes 8. The added flexibility of the reduced thickness $D_{ta}$ provides for better compensation of thermal stress. In one form, the tubes 8 may be brazed to the ferrules 28. In detail, the tubes 8 are joined together with the ferrules 28 by melting a filler metal with a lower melting point and making it flow into the overlapping length, thereby creating a fluid-tight connection.

In addition to the trough-shaped tie bars 30, FIG. 5 also shows one of the slot support tie bars 44 and the ferrule 28' surrounding the core cover slot 50 that forms the end of the row of passages 12 and 50 (See FIG. 3). In the shown version of the header 2, the ferrule 28' is generally shaped like the ferrules 28 holding the tubes 8. The transitional area 40' forms a minimum thickness, between the ferrule 28' and the bottom 34', which is greater than a minimum thickness $D_{ta}$ of the transition area 40 formed in the first side wall 46 and the tie bars 30. Thus, the slot support tie bar 44 provides not only an increased rigidity to the core cover 9 but also flexible hinge for the tubes 8 through the first and second side walls 46, 48, of which shapes are different each other.

As discussed above in conjunction with the outer surface of the heat exchanger 1, the matrix of alternating tubes 8 and cooling fins 14 is bordered at each end by the core covers 9 extending from one tube header 2 to the other, and thus each contact area between the tab 70 and the core cover slot 50 when assembled each other is exposed to various external forces such as compressive stress, bending moments, and any other forces associated with thermal cycle, pressure cycle and vibration during the operation of the heat exchanger 1 and regulatory test cycles. In order to endure such hard conditions and to improve the support for the assembled the tube header 2 and the core cover 9, the present disclosure provides the configuration that increases the contact area between the core cover 9 and tube header 2 by extending the elongated core cover slot 50 as wide as the elongated passage 12 so that the core cover slot 50 may receive a tab 70 of which width is wide as much as the width of tubes 8.

In more detail, referring to FIG. 2B, an opening length C1 of the core cover slot 50 is equal to or greater than three quarters of an opening length C2 of the passage 12. In another form, the opening length C1 of the core cover slot 50 is at least equal to or greater than the opening length C2 of the elongated passage 12 based on the design of the heat exchanger. With this configuration of the tube header 2, the contact area between the core cover 9 and tube header 2 is increased and thus strengthens the assembled heat exchanger 1.

Figure 6:
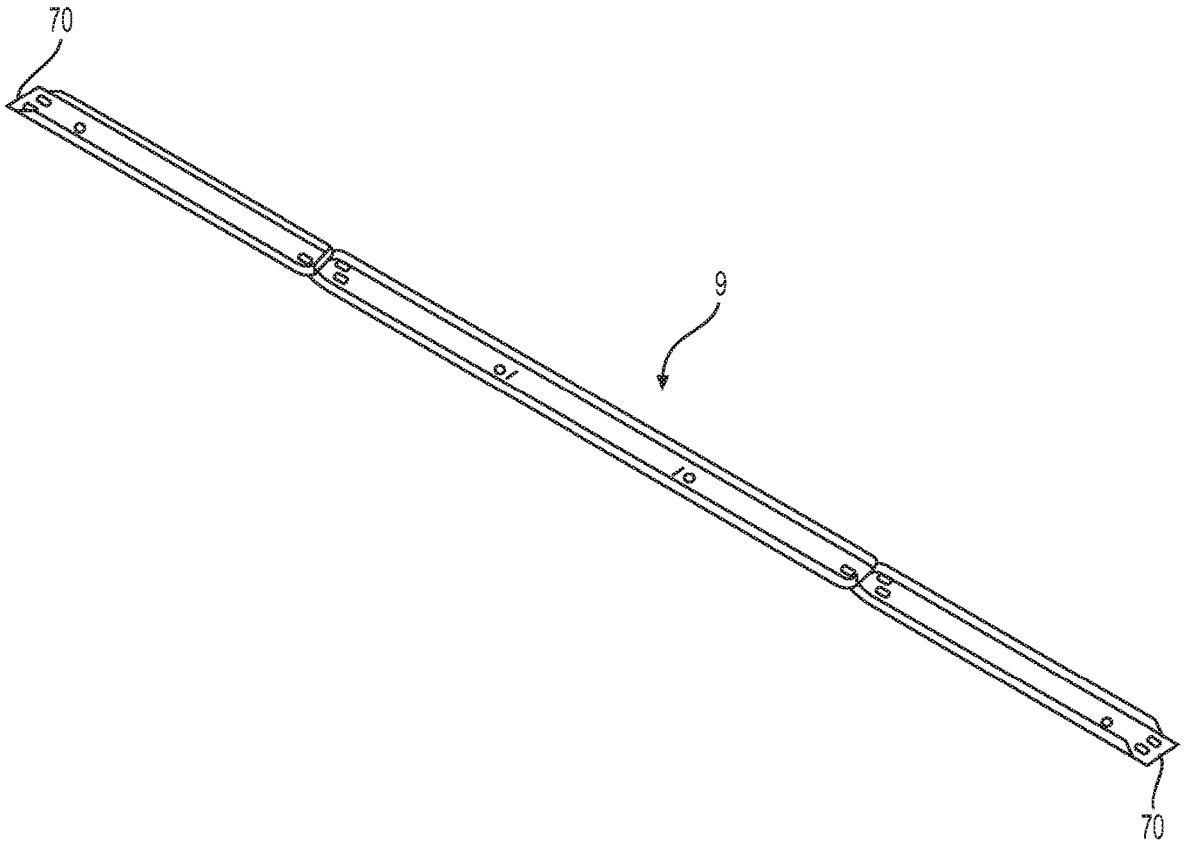
FIG. 6 is a perspective view of a core cover suited for a heat exchanger.
Figure 7A:
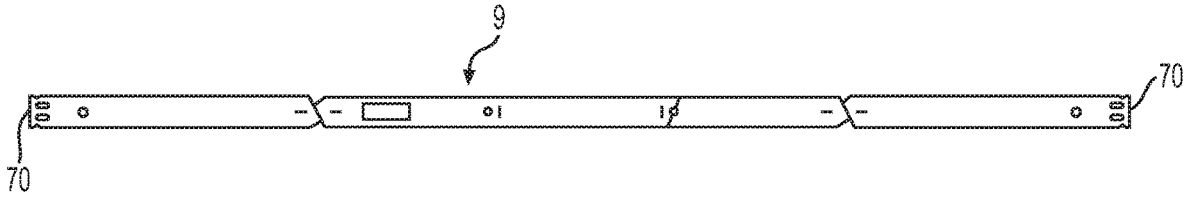
FIG. 7A is a top view of the core cover of FIG. 6 in one form.
Figure 7B:
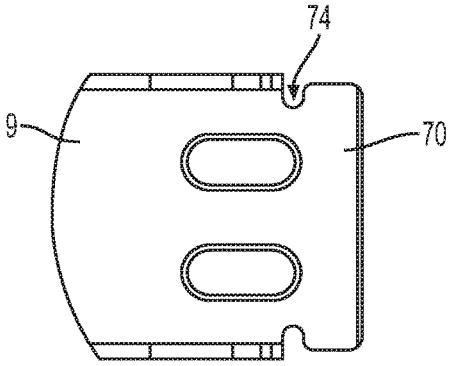
FIG. 7B is an enlarged view of an end portion of the core cover of FIG. 7A.

As one exemplary form of the present disclosure, the cover 9 having two tabs will be described with reference to FIGS. 6-8B. FIG. 6. is a perspective view of a core cover suited for the heat exchanger, FIG. 7A is a top view of the core cover of FIG. 6, and FIG. 7B is an enlarged view of an end portion of the core cover of FIG. 7A. As illustrated in FIG. 6, the core cover 9 has, at ends, at least two tabs each having a width substantially equal to the opening length C1 of the corresponding core cover slot 50, and each tab 70 is inserted into the corresponding core cover slot 50 and may be mounted each other by brazing in an assembling process of the heat exchanger.

Figure 8A:
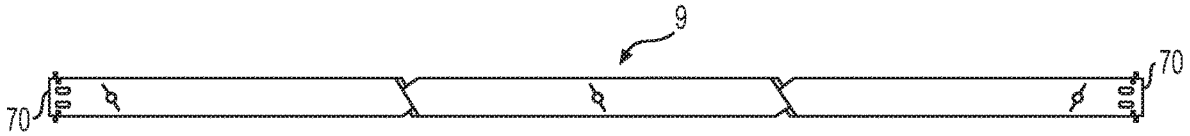
FIG. 8A is a top view of the core cover of FIG. 6 in another form.
Figure 8B:
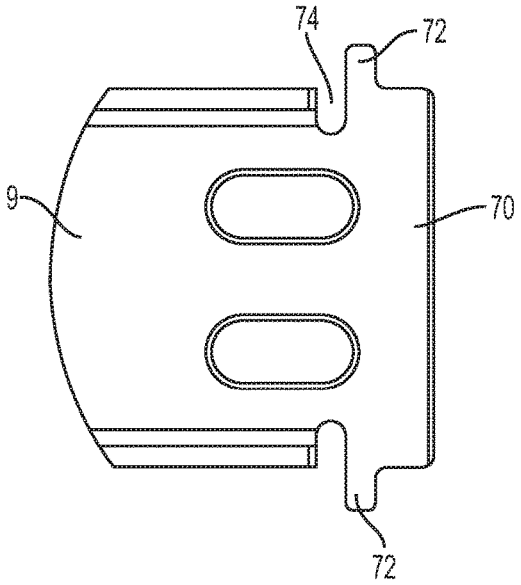
FIG. 8B is an enlarged view of an end portion of the core cover of FIG. 8A.

In order to increase mounting rigidity between the core cover 9 and tube header 2, the end portion of the core cover 9 may be modified to have various shapes. For example, as illustrated in FIGS. 8A-8B, each tab 70 may include a pair of outwardly extended portions 72 that protrude from the tab 70 in the direction of the width W of the header plate 2 on both lateral sides for supplementarily securing the core cover to the tube header. FIG. 8A is a top view of the core cover 9 in another form, and FIG. 8B is an enlarged view of an end portion of the core cover.

Here, the supplemental support provided by the extended portions 72 is described in detail. The core cover 9 is assembled with the tube header 2 by inserting the tab 70 to the core cover slot 50, and then the extended portions 72 are brazed and fixed on the header plate 22. The brazed extended portions 72 on the header plate 22 provide additional mounting areas between the core cover and tube header. As a result, the support to the tube header is enhanced. Depending on the design of the heat exchanger, the extended portions 72 may be inserted through the core cover slot 50, or may not be inserted. In another form, the tab 70 may have a lateral recess 74 adjacent to each the extended portion 72 to hold the header plate 22 when the core cover 9 is assembled with the tube header 2.

As discussed above in connection with the core cover slot 50, the cross-section profile of the tab 70 is designed to match with the shape of the elongated core cover slot 50. Thus, the width of the tab 70 is equal to or greater than three quarters of the opening length C2 of the passage 12. In another form, the width of the tab 70 may be equal to or greater than the opening length C2 of the elongated passage 12. This means that the width of the tab 70 and opening length C1 of the core cover slot 50 have a greater width than the opening length C2 of the passage 12 in order to increase the contact area between the core cover 9 and the tube header 2.

With this arrangement, the durability of the core cover 9 fixed to the tube header 2 is improved when assembled each other. For example, when the opening length C2 of the passage 12 is approximately 26 mm, the elongated core cover slot 50 may have approximately 24 mm opening length C1 to receive a tab 70 having a width of approximately 24 mm. In another form, the width of tab 70 may be designed to have a 26 mm width to be inserted into the core cover slot 50 having an approximately 26 mm opening length (i.e., C1). The 26 mm opening of the core cover slot 50 may be embedded in the tube header 2 having plurality of elongated passages 12 with 26 mm opening length (i.e., C2) so that the contact area between the tab 70 and the tube header, more particularly, the header plate 22, is increased, providing more rigid security. However, if desired for the design of the heat exchanger, the opening length C2 of the passages 12 may be reduced and thus becomes smaller than the opening length C1 of the cover slot 50. Generally, for easy assembly, the opening length may be 1 mm to 3 mm greater than the tab. This spacing allows for a braze fillet to close the gap.

In addition to the widely open core cover slot 50 to receive the wide tab 70 compared to a core cover slot and a tab of a conventional core cover, the lateral recesses 74 and the extended portions 72 are formed in the side end portions of the core cover 9. As illustrated in FIG. 8B, the portion 72 is extended from a longitudinal center of the core cover 9 outward in a direction perpendicular to the longitudinal direction of the core cover 9. As a result, the portion 72 is protruded beyond the periphery of the core cover 9. In one form, the extended portions 72 have an overall width of approximately 32 mm, while the tab 70 absent the extended portions 72 has a width of approximately 26 mm. Thus, in this case, the extended portions laterally protrude beyond the tab by about 3 mm each. The lateral recesses 74 are inwardly recessed toward the longitudinal center of the core cover 9. In this form, the width of the core cover 9 in the location of the lateral recesses 74 may be approximately 20 mm.

As described in FIG. 8B, the recessed portion 74 and extended portion 72 are continuously formed along the side periphery of the core cover 9 at its end portions but terminated before the tab 70. With this configuration, the tab 70 and the extended portion 72 are inserted through the core cover slot 50 to be assembled with the tube header 2. In another form, only the tab 70 is inserted through the core cover slot 50 while the extended portion 72 is not inserted into the core cover slot 50. Instead, the extended portion 72 abuts against the corresponding part of the header plate 22 and brazed on the header plate 22.

As discussed above, the present disclosure provides a tube header and a core cover assembled together with an increased contact area between a core cover tab and a header plate. The increased contact area contributes to improving durability of the heat exchanger exposed to bending moments, tensile and compressive stress. In particular, the bending moments and stress are more intense at the corners of the heat exchanger where the core cover and tube header are assembled. The increased contact area and the slot support tie bars as described above improve durability of the heat exchanger even at the corners. As a result, the service life of the heat exchanger increases by reducing bending forces/moments on the corners of the tube header subjected to thermal, pressure, or vibrational loading during operation of the heat exchanger (e.g., a radiator).

The present disclosure being thus described, it will be obvious that the same may be varied in many ways. Such variations are not to be regarded as a departure from the spirit and scope of the present disclosure, and all such modifications as would be obvious to one skilled in the art are to be included within the scope of the present disclosure.

What is claimed is:

1. A heat exchanger with at least one header box and a plurality of tubes extending therefrom, the header box comprising a tube header having:

a header plate defining a header plane;

a row of oblong passages extending through the header plate;

a plurality of tie bars, each tie bar arranged between a pair of adjacent oblong passages; and a core cover having a tab protruding from the core cover in a longitudinal direction, the tab having a free end in the longitudinal direction with a tab width in a lateral direction adjacent to the free end, the tab including an extended portion laterally extending from the tab in a location longitudinally spaced from the free end of the tab such that the extended portion protrudes laterally beyond the tab width adjacent to the free end of the tab, wherein the tab further includes a recessed portion directly adjacent to the extended portion and recessed further inward than the tab width, and wherein the header plate includes a core cover slot of which opening length is at least three quarters of an opening length of one of the oblong passages to receive the plurality of tubes, respectively.

2. The heat exchanger of claim 1, wherein the tab width is equal to or greater than the opening length of one of the oblong passages.

3. The heat exchanger of claim 1, wherein the extended portion secures the core cover to the tube header.

4. The heat exchanger of claim 1, wherein the recessed portion is configured to hold the header plate when the core cover is assembled with the tube header.

5. The heat exchanger of claim 1, wherein after the heat exchanger is assembled, the extended portion of the tab is fixed on the tube header by brazing.

6. The heat exchanger of claim 1, wherein the opening length of the core cover slot is at least equal to or greater than the opening length of one of the oblong passages.

7. The heat exchanger of claim 1, wherein the header plate includes at least one slot support tie bar including a first side wall and a second side wall, and the first side wall adjacent to the tube has a different length than the second side wall adjacent to the core cover slot.

8. The heat exchanger of claim 7, wherein a length of the first side wall is greater than a length of the second side wall.

9. The heat exchanger of claim 1, wherein the header plate includes at least one slot support tie bar including a first side wall and a second side wall, and the first side wall adjacent to the tube has a different height than the second side wall adjacent to the core cover slot.

10. The heat exchanger of claim 9, wherein a height of the first side wall is greater than a height of the second side wall.

11. The heat exchanger of claim 7, wherein the core cover slot is formed by the second side wall and a flange attached to a header tank.

12. The heat exchanger of claim 7, wherein the first side wall has a transition area having a reduced wall thickness that is smaller than a wall thickness of a ferrule forming a corresponding oblong passage to receive the tube.

13. The heat exchanger of claim 12, wherein each oblong passage is bordered by the ferrule monolithically formed with the header plate, the ferrule having a surrounding wall extending perpendicular to the header plane and having a wall thickness, and at least one ferrule is extended by the first side wall toward the header plane.

14. The heat exchanger of claim 12, wherein a wall thickness of the second side wall is greater than the wall thickness of the ferrule.

15. The heat exchanger of claim 12, wherein the wall thickness of the first side wall is gradually reduced over the transition area with a slope angle.

16. The heat exchanger of claim 12, wherein a depth of the core cover slot is greater than a depth of the ferrule.

17. The heat exchanger of claim 12, wherein a height of core cover slot from the header plane is less than a height of the ferrule from the header plane.

18. The heat exchanger of claim 7, wherein a transition area with a reduced wall thickness of the second side wall is shorter than the transition area of the first side wall.

* * * * *